US007017485B2

(12) United States Patent
Albert et al.

(10) Patent No.: US 7,017,485 B2
(45) Date of Patent: Mar. 28, 2006

(54) DEVICE AND METHOD FOR CONTROLLING WEB TENSION

(75) Inventors: Kevin Francis Albert, Barrington, NH (US); David Charles Burke, Portsmouth, NH (US)

(73) Assignee: Goss International Americas, Inc., Dover, NH (US)

( * ) Notice: Subject to any disclaimer, the term of this patent is extended or adjusted under 35 U.S.C. 154(b) by 382 days.

(21) Appl. No.: 09/534,466

(22) Filed: Mar. 24, 2000

(65) Prior Publication Data

US 2003/0079629 A1 May 1, 2003

(51) Int. Cl.
*B41F 13/54* (2006.01)

(52) U.S. Cl. ..... 101/228; 101/DIG. 42

(58) Field of Classification Search ..... 101/226, 101/227, 228, DIG. 42; 226/42, 44, 91
See application file for complete search history.

(56) References Cited

U.S. PATENT DOCUMENTS 4,359,178 A * 11/1982 Hayashi et al. ..... 226/25
4,417,516 A * 11/1983 Fischer ..... 101/181
4,838,498 A 6/1989 Huth ..... 242/75.51
5,791,541 A 8/1998 Jitsuishi et al. ..... 226/40
5,996,492 A * 12/1999 Jurkewitz et al. ..... 101/228
6,073,876 A * 6/2000 Suzuki et al. ..... 242/421.6
6,085,956 A * 7/2000 Sainio et al. ..... 101/228
2001/0027731 A1 10/2001 Schramm ..... 101/216

FOREIGN PATENT DOCUMENTS

DE 19712689 10/1998
EP 1136258 9/2001
JP 10181971 7/1998

* cited by examiner

*Primary Examiner*—Ren Yan
(74) *Attorney, Agent, or Firm*—Davidson, Davidson & Kappel, LLC

(57) ABSTRACT

A method for controlling tension in a web of a printing press, the printing press including an infeed, printing units and a folder, the method comprising the steps of increasing an infeed tension in the web between the infeed and the printing units when the printing units change to a printing mode from a white web mode; and decreasing the infeed tension in the web when the printing units change from the printing mode to the white web mode. Also disclosed is a web printing press which includes an infeed for providing a web of material to be printed; at least one printing unit for printing the web, the printing unit having a printing mode and a white web mode; a folder for cutting the web into signatures; and a controller for controlling the tension in the web between the infeed and the printing units and the tension after the printing units, the controller controlling the tension between the infeed and the at least one printing unit as a function of a transition between the printing mode and the white web mode.

11 Claims, 3 Drawing Sheets

Typical Time History of Press Web Tensions

Controlled Time History of Press Web Tensions

DEVICE AND METHOD FOR CONTROLLING WEB TENSION

BACKGROUND OF THE INVENTION

1. Field of the Invention

The present invention relates generally to web printing presses and more particularly to a method and device for controlling web tension in a web printing press 2. Background Information Web printing presses print a continuous web of material, such as paper. During printing, the web of material is acted on by various printing cylinders, which transfer ink to the web. For example, in a four-color double-sided offset lithographic printing press, four pairs of blanket cylinders form nips through which the web passes. During printing, the blanket cylinders contact the web and provide ink to both sides of the web.

During start-up or shut-down, or during plate changes, it is often desirable to have the web press running in a non-printing mode, where the printing cylinders contacting the web are thrown-off so that they do not print on the web. For example, the blanket cylinders in a print unit of a web offset printing press can be separated from each other so that ink is not applied to the web. The web however continues to run through the print unit.

The web in this non-printing condition is known as a white web, since ink is not be applied to the web.

When the press then resumes or begins a printing mode, the tension in the web changes due to the inking and wetting of the web as the web travels through the nips in the printing units. For example, the modulus of elasticity of the web changes due to the application of the ink and any wetting solution. These tension changes in the web can result in web weaving, wrinkling, and increased sensitivity to web defects, often resulting in a web break. Web breaks cause increased press down time created while the web is threaded again through the press. FIG. 1 shows a chart of web tension changes in pounds per linear inch versus time in one example of a prior art web printing press. Tension at an infeed is held constant, for example by a dancer roll and/or PID (proportional, integral, and derivative) controller, as shown by line 1. When impressions are turned on in the press, indicated at about 4 minutes on the time axis, the tension of the web after the printing units drops due to the wetting and inking of the web and the interaction of the printing nip with the web. For example, the tension in the web from the printing units until a first nip in a chill unit is indicated by arrow 2, the tension in the web from the last chill unit nip to a slitter unit is indicated by arrow 3, and a tension in the web from the slitter unit to a folder where the web is cut into signatures is indicated by arrow 4. As can be seen, when impressions are turned on, the tension decreases dramatically for the web as the web travels through the post-printing unit sections.

Active tension controls for a web are known, such as the Bardac SP1070PID Controller for controlling a dancer arm. Tension in the web is adjusted by changing the load on a dancer arm using a PID controller. However, tension controls have not been used to compensate for transient events, such as when impression goes on or off, since active tension control in the post-printing unit sections in response to these events would result in unacceptable variation in the relationship of the image to a cut edge of the resulting signatures.

U.S. Pat. No. 4,838,498 discloses a system for controlling the feeding of web from a supply reel into a web fed printing unit, the system comprising a dancer roll means. U.S. Pat. No. 5,791,541 discloses a tension controller for controlling the tension of running paper web in a rotary press, the tension controller including a floating roller unit. Both of these patents attempt to control the tension caused by speed changes in the infeed, and do not concern themselves with the problems caused by the change in tension in the web due to the wetting and inking of the web. Both of these patents however are hereby incorporated by reference as showing possible dancer roll arrangements for controlling web tension.

BRIEF SUMMARY OF THE INVENTION

An object of the present invention is to provide for more stable tension throughout a printing press, including after the printing units, during the transition between white web and printing modes.

The present invention provides a method for controlling tension in a web of a printing press, the printing press including an infeed, printing units and a folder, the method comprising the steps of:

increasing an infeed tension in the web between the infeed and the printing units when the printing units change to a printing mode from a white web mode; and decreasing the infeed tension in the web when the printing units change from the printing mode to the white web mode.

By increasing and decreasing the infeed tension during the transients caused by the change from a white web (non-printing mode) to a printed web (printing mode), tensions in sections of the press after the printing units can be maintained at more constant level, thus reducing web breaks and imperfections in the printed products. The change in tension in the infeed causes fewer printing disturbances and also is not as large a danger for web breaks, as the web is not yet inked and wetted.

The present invention preferably includes the steps that tension is maintained at a generally constant level in the web after the printing units;

The tension levels preferably are controlled by a PLC (programmable logic controller) which may be connected by a LAN (local area network) to various press sections. Tension control can be provided using, for example, dancer rollers similar to those used in U.S. Pat. Nos. 4,838,498 and 5,791,541, which are hereby incorporated by reference herein, and/or by controlling the speed of various rollers, including rollers forming nips at the web, by drive controllers. PID control algorithms of the PLC preferably are used to set the tension in the various web sections, with information be transmitted over the LAN. An external controller may control the PLC, for example through an RS 232 bus. The external controller may be, for example, a PENTIUM-based personal computer.

Preferably, the press includes a chill unit for cooling the web after the web passes through a drying unit. Therefore after exiting the printing units the web first contacts a nip in the chill unit, so as to define a printing unit to chill section of the web. The web then may pass over chill rolls to a slitter, which also provides a nip, thereby defining a chill unit to slitter section. From the slitter to the folder, which has a cutting unit, a slitter to folder section may be defined. A chill unit to folder section may be defined if a slitter is not present.

The present invention can set the tension in each of the various separately defined web sections of the press, and provide for post-printing unit tension stability, even during transitions between printing and white web modes. Preferably, the present method may set the white web mode and printing web mode tensions after the printing units at a substantially similar value. "Substantially similar" as defined herein with regard to tension in the web means that the web tension does not vary by more than that caused by minor disturbances such as splicing and wash operations.

The present invention also provides a web printing press comprising an infeed for providing a web of material to be printed, at least one printing unit for printing the web, a folder for cutting the web into signatures, and a controller for controlling the tension in the web between the infeed and the printing units and the printing units and the folder. The at least one printing unit has a printing mode and a white web mode, and the controller controls the tension between the infeed and the at least one printing unit as a function of a transition between the printing mode and the white web mode.

Preferably, web printing press further includes a chill unit and a slitter located between the printing units and the folder. A LAN may be set up to control and set tension in each section of the printing press, from the infeed to the folder. This control may be performed using dancer rolls, or controlling the speed at the infeed and the various nips throughout the press. It is noted that the printing nips are usually set to run at generally the same speed as the web, and are not necessarily controlled by the controller.

The controller preferably is a PLC which is further controlled by an external controller. The controller may receive inputs regarding the tension in the various web sections and on the printing mode status of the printing units.

Figure 1:
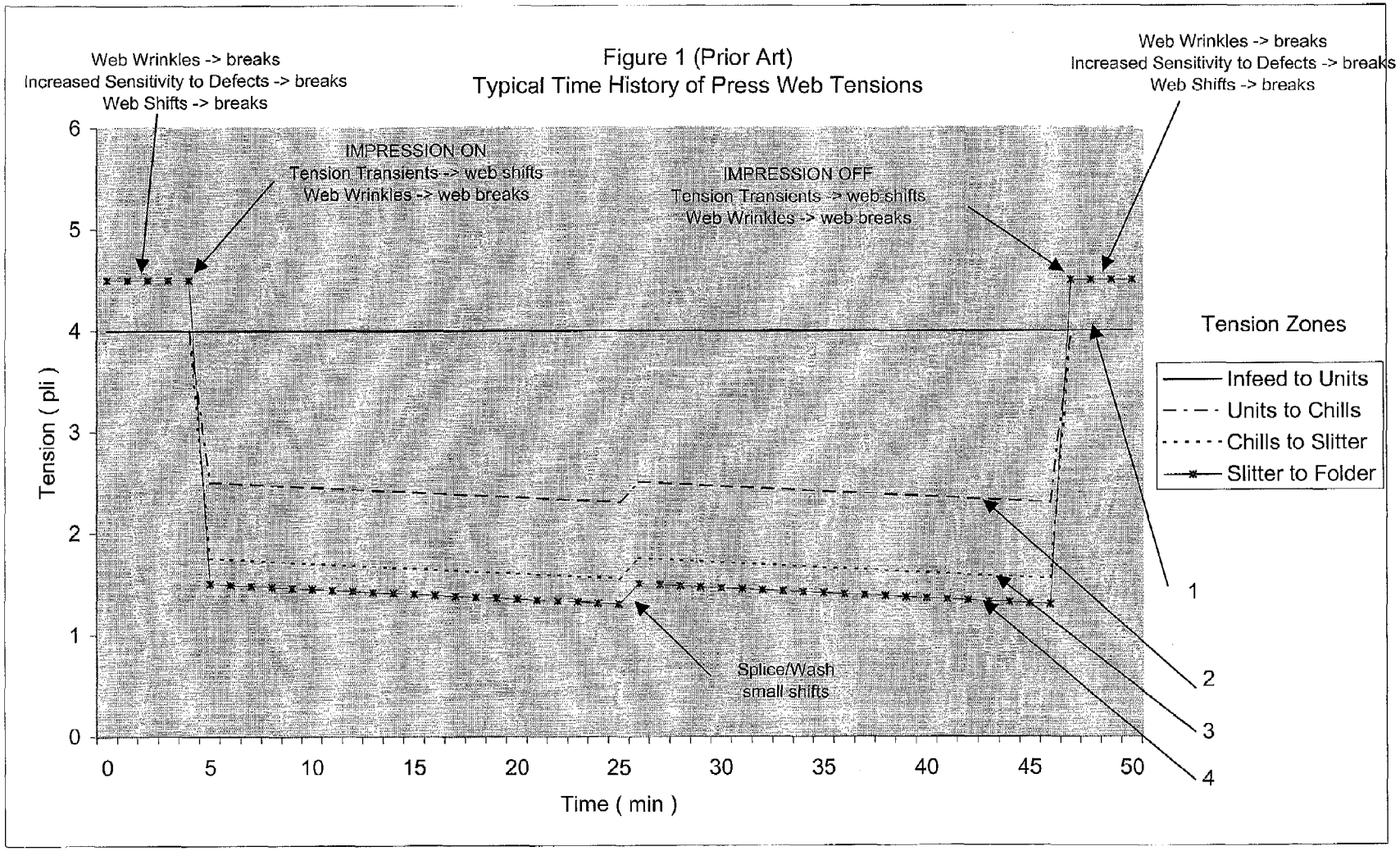
Figure 1 (Prior Art)
FIG. 1 shows a graph of web tension at various sections in a prior art press, and is described in the background section above.
Figure 2:
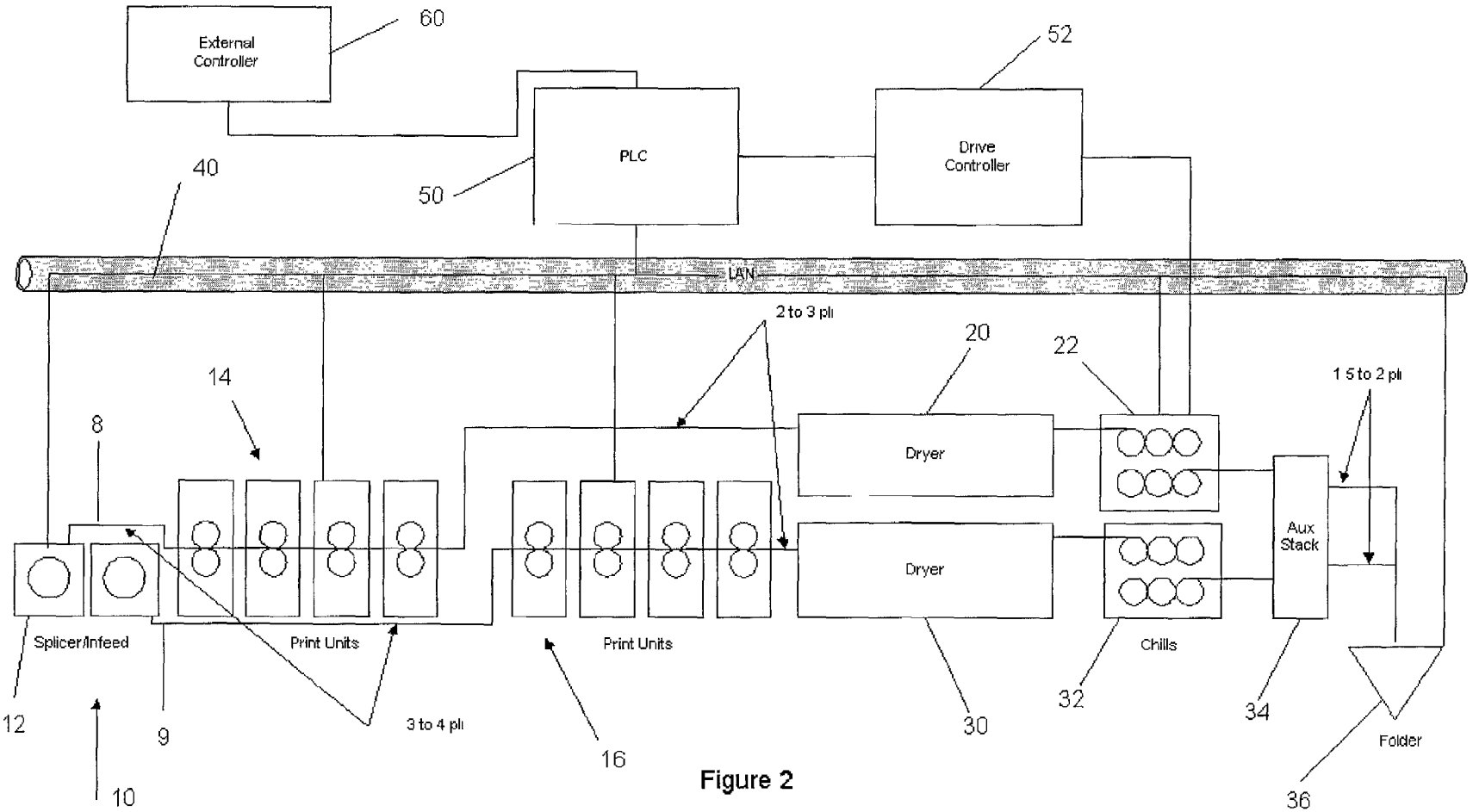
Figure 3:
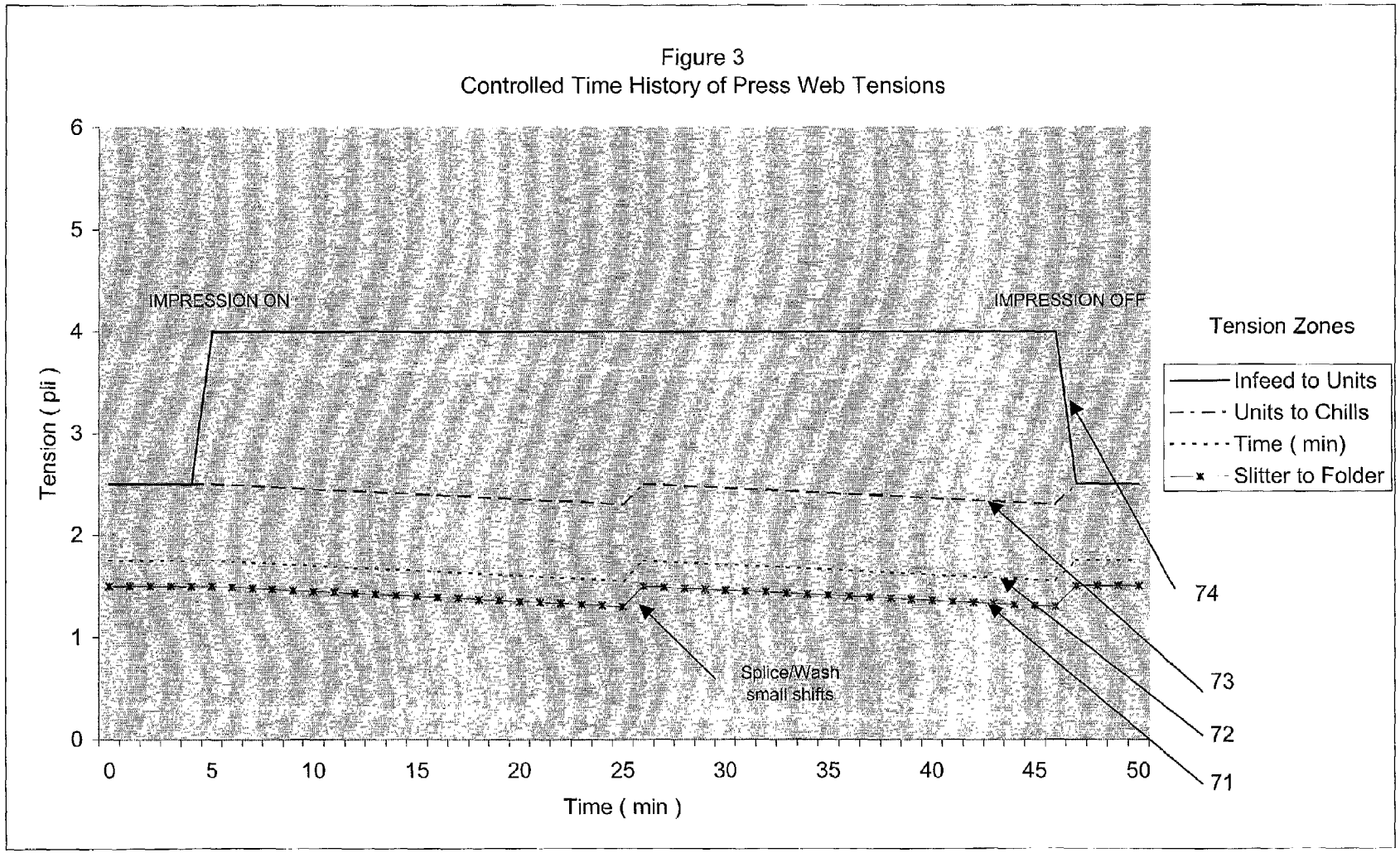

A preferred embodiment of the present invention is described below by reference to the following drawings, in which:

FIG. 2 shows a schematized view of the printing press of the present invention; and FIG. 3 shows a graph of web tension in a printing press according to the present invention.

DETAILED DESCRIPTION

FIG. 2 shows schematically a printing press 10 according to the present invention. A splicer infeed unit 12 provides a dual web, including a first web 8 and a second web 9. First web 8 passes through a first set 14 of printing units, while second web 9 passes through a second set 16 of printing units. Each set 14, 16 of printing units can print a four-color image, and each printing unit may be an offset lithographic printing unit having a blanket and a printing plate. Webs 8, 9 then pass through drying units 20, 30, respectively, where the web typically is not contacted but only heated and dried. Webs 8, 9 then pass to chill units 22, 32 respectively, where the web meet a first chill nip and exit at a chill exit roller.

Webs 8, 9 then pass to slitter unit 34 which can partially cut the webs, but the web still passes through a slitter nip. A folder 36 can cut the combined webs into signatures.

The printing press further includes a PLC 50 connected to a LAN 40. A drive controller 52 may be provided to control the speed of the web through the chill rolls. PLC 50 may be controlled and programmed by an external controller 60, for example a personal computer.

While a double web press has been described above, the present invention could just as well work with a single web press.

FIG. 2 shows possible desired tensions during a printing mode in various sections of press 10 for the present invention. Between infeed 12 and printing units 14, 16, a tension of 3–4 pounds per linear inch for webs 8,9 may be desirable, while between printing units 14, 16 and chill units 22, 32, respectively, tensions of 2 to 3 pli may be desirable, while between the chill units 22, 32 and the folder tensions of 1.5 to 2 pli may be desirable.

The tension may be set using dancer rollers controlled through LAN 40 and/or by controlling driving nips through the LAN 40. By controlling the drive nips or moving the dancer rollers, tension in both printing and white web modes may be controlled, as is known in the art. The use of PID control algorithms is particularly advantageous for this purpose.

Desired tensions will vary depending upon the type of press and paper or other web material used.

As shown in FIG. 3, the tension during a white web can be set in various sections of the press using the PLC. For example, the slitter to folder section may be set at the outset at about 1.4 pli as indicated by line 71, the chill to folder section at 1.7 pli as indicated by line 72, and the infeed to the chill units at 2.5 pli, as indicated by lines 73 and 74, which converge during a white web because the printing nips are not active.

When controller 50 receives a signal indicating that the white web is to change to an impressions on or printing mode, i.e. that printing is to start, the controller sends an impulse signal to splicer infeed unit, which may have a dancer roll, to increase the tension setpoint of the infeed from 2.5 pli to approximately 4.0 pli, as shown by line 74. This impulse and sudden tension rise compensates for the tension decrease brought about by the printing inks and solution being applied to the web, so that the tensions in the post-printing unit web can remain relatively stable, as shown by lines 71, 72 and 73. The actual tension increase desired can vary as a function of press speed, type of press, and paper being used, and may be partially or totally predetermined based on actual trials, or can be based on predictive methods.

If needed, web tension in the post-printing unit section can be adjusted slightly via the PLC to maintain tension, although large changes in tension during printing are not desired since print and cut quality could be adversely affected.

When the printing units revert to the white web mode, tension is decreased in the infeed to printing units section, so that the post-printing unit web is generally unaffected by the end of the printing operation.

The present invention provides advantages in press operation, since the post-printing unit section of the press, where web breaks and printing defects often occur, realizes a more stable tension environment.

In a preferred embodiment, the tension is controlled at the infeed units by changing a tension setpoint as a function of press speed, which is an input to the PLC. The area from the chill rolls to the folder may be controlled using a PID control algorithm with the span tension as an input and the chill gain as an output. As such, the tension can be regulated by speeding up or slowing down a chill drive motor. The sequencing of the nipping rollers in different section of the press can also be controlled to optimize the tension regulating, for example by engaging the nip roller in the chill section the response to the changes in chill gain may be increased. The commands from the PLC may be on/off commands to the nip rolls, as well as chill gain commands and/or tension setpoint commands.

A "white web mode" as defined herein is a mode wherein the web is running through the press but is not being printed.

What is claimed is:

1. A method for controlling tension in a web of a printing press, the printing press including an infeed, printing units and a folder, the method comprising the steps of:

increasing an infeed tension in the web between the infeed and the printing units in response to a signal indicating a change to a printing mode from a white web mode; and decreasing the infeed tension in the web in response to a further signal indicating a change from the printing mode to the white web mode.

2. A method for controlling tension in a web of a printing press, the printing press including an infeed, printing units and a folder, the method comprising the steps of:

increasing an infeed tension in the web between the infeed and the printing units in response to a signal indicating a change to a printing mode from a white web mode; and decreasing the infeed tension in the web in response to a further signal indicating a change from the printing mode to the white web mode, wherein the infeed tension is increased so that a substantially similar tension is maintained in the web after the printing units during the change from the printing mode to the white web mode.

3. A method for controlling tension in a web of a printing press, the printing press including an infeed, printing units and a folder, the method comprising the steps of:

increasing an infeed tension in the web between the infeed and the printing units in response to a signal indicating a change to a printing mode from a white web mode; and decreasing the infeed tension in the web in response to a further signal indicating a change from the printing mode to the white web mode, wherein the tension is controlled via a PLC.

4. The method as recited in claim 3 wherein the PLC is connected to a LAN.

5. A method for controlling tension in a web of a printing press, the printing press including an infeed, printing units and a folder, the method comprising the steps of:

increasing an infeed tension in the web between the infeed and the printing units in response to a signal indicating a change to a printing mode from a white web mode; and decreasing the infeed tension in the web in response to a further signal indicating a change from the printing mode to the white web mode, wherein the tension after the printing units is controlled by a PLC controller so as to maintain a substantially similar tension in the web during the change from the printing mode to the white web mode.

6. A web printing press comprising:

an infeed for providing a web of material to be printed;

at least one printing unit for printing the web, the printing unit having a printing mode and a white web mode;

a folder for cutting the web into signatures; and a controller for controlling the tension in the web between the infeed and the at least one printing unit and the tension after the at least one printing unit, the controller controlling the tension between the infeed and the at least one printing unit in response to a signal indicating a transition between the printing mode and the white web mode.

7. The web printing press as recited in claim 6 further comprising a chill unit and a slitter located between the printing units and the folder.

8. The web printing press as recited in claim 6 further comprising a LAN connected to the controller.

9. The web printing press as recited in claim 6 wherein the controller is a PLC.

10. The web printing press as recited in claim 6 wherein the controller receives inputs concerning printing mode and press speed.

11. The web printing press as recited in claim 6 wherein the web printing press is an offset lithographic printing press.

* * * * *

UNITED STATES PATENT AND TRADEMARK OFFICE

CERTIFICATE OF CORRECTION

PATENT NO. : 7,017,485 B2
APPLICATION NO. : 09/534466
DATED : March 28, 2006
INVENTOR(S) : Kevin Francis Albert and David Charles Burke It is certified that error appears in the above-identified patent and that said Letters Patent is hereby corrected as shown below:

Title Page, Col. 2, "other Publications" Please insert;
--Bardac – SP 1070PID Basic PID Controller-- disclosed in the Information Disclosure Statement filed with the application should be listed as prior art on the face of the patent Column 2, line 40 should read --after the printing units.-- instead of "after the printing units;".

Signed and Sealed this

Twenty-eighth Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,017,485 B2
APPLICATION NO. : 09/534466
DATED : March 28, 2006
INVENTOR(S) : Kevin Francis Albert and David Charles Burke It is certified that error appears in the above-identified patent and that said Letters Patent is hereby corrected as shown below:

In the Claims:

Column 5, lines 27 – 30, claim 2:

"wherein the infeed tension is increased so that a substantially similar tension is maintained in the web after the printing units during the change from the printing mode to the white web mode.".

should read

"wherein the infeed tension is increased so that a substantially similar tension is maintained in the web after the printing units during the change to the printing mode from the white web mode.".

Column 6, lines 11 – 14, claim 5:

"wherein the tension after the printing units is controlled by a PLC controller so as to maintain a substantially similar tension in the web during the change from the printing mode to the white web mode".

should read

"wherein the tension after the printing units is controlled by a PLC controller so as to maintain a substantially similar tension in the web during the change to the printing mode from the white web mode.".

Signed and Sealed this
Twenty-fourth Day of September, 2013

Teresa Stanek Rea
*Deputy Director of the United States Patent and Trademark Office*